United States Patent [19]

Mattei et al.

[11] Patent Number: 4,531,627

[45] Date of Patent: Jul. 30, 1985

[54] DEVICE FOR FORMING GROUPS OF CIGARETTES IN CIGARETTE PACKAGING MACHINES

[75] Inventors: Riccardo Mattei; Gastone Dall'osso, both of Bologna, Italy

[73] Assignee: G.D. Societa Per Azioni, Bologna, Italy

[21] Appl. No.: 513,218

[22] Filed: Jul. 13, 1983

[30] Foreign Application Priority Data

Sep. 8, 1982 [IT] Italy ..... 3523 A/82

[51] Int. Cl.[3] ..... B65G 47/26

[52] U.S. Cl. ..... 198/420

[58] Field of Search ..... 198/419, 420; 53/148, 53/150, 151, 154, 149, 153; 131/282

[56] References Cited

U.S. PATENT DOCUMENTS

| | | | |
|---|---|---|---|
| 1,870,533 | 8/1932 | Scott et al. | 53/148 |
| 2,778,476 | 1/1957 | Engleson et al. | 198/420 |
| 3,590,556 | 7/1971 | Folke | 53/151 |
| 3,642,112 | 2/1972 | Seragnoli | 198/419 |
| 4,362,235 | 12/1982 | Erdmann | 198/419 |
| 4,364,464 | 12/1982 | Manservisi et al. | 198/419 |

*Primary Examiner*—Joseph E. Valenza
*Assistant Examiner*—Kyle E. Shane

[57] ABSTRACT

An improved device (1) for forming groups (3) of cigarettes in cigarette packaging machines, in which a group forming wheel (2) comprises, uniformly distributed along its periphery, axial containers (8) each arranged to receive several layers (31, 32, 33) of cigarettes constituting the contents of one packet; said layers (31, 32, 33) being fed in succession into each container (8) during its traversing of a loading station (7), and retention means (34;56) being mobile with said container (8) at least during said traversing, in order to transversely retain the layers (31, 32, 33) in position once inserted, said retention means (34;56) being arranged to oscillate radially relative to the forming wheel (2).

7 Claims, 5 Drawing Figures

DEVICE FOR FORMING GROUPS OF CIGARETTES IN CIGARETTE PACKAGING MACHINES

FIELD OF THE INVENTION

This invention relates to an improved device for forming groups of cigarettes in cigarette packaging machines.

BACKGROUND OF THE INVENTION

In cigarette packaging machines, it is known to use a wheel for forming cigarette groups, each arranged to constitute the contents of one packet. For this purpose, said forming wheel comprises a plurality of axial containers which, during the rotation of said wheel, pass through a loading station comprising an outlet of a cigarette feed hopper, and receive from this latter several successive superposed layers of cigarettes.

In particular, in the most common case, said hopper comprises three separate outlet mouths, each of which is divided into a plurality of channels of number equal to the number of component cigarettes in the individual layers.

Normally, said loading station also comprises pusher elements which act axially on the cigarettes disposed mutually adjacent at the lower end of the individual mouths, to push them into said axial containers as these latter pass in front of said mouths.

One of the main problems which arise during the formation of groups of cigarettes by means of the successive superposing of layers consists of the fact that these latter, as they are superposed one of another, must be kept in position radially relative to said forming wheel.

At present, there are two main methods used for retaining the layers of cigarettes in a radial direction.

The first of the aforesaid methods, described for example in USA Pat. No. 2,334,142 and in British Patent No. 2,048,837, consists of disposing in each container fixed separation baffles wich divide the container into several superposed compartments each arranged to receive one layer of cigarettes.

The second of said methods, described in USA Pat. No. 3,603,445, consists of disposing in each container elastic elements arranged to act transversely on the cigarettes in a direction parallel to each of said layers.

Both the aforesaid methods have drawbacks when applied to extremely fast packaging machines, i.e. packaging machines in which the rotational speed of the forming wheel is extremely high, and in which the rate of insertion of the layers of cigarettes into the relative containers is likewise high.

In this respect, transversely locking the layers of cigarettes by the aforesaid elastic elements or the like is insufficient to retain the layers in position when the centrifugal force applied to the cigarettes exceeds a certain limit. On the other hand, the presence of baffles in the containers automatically limits the rate of introduction of the cigarettes, which in order not to collide with said baffles must, before being introduced into the relative containers, pass through a sort of die which radially compresses them, causing tearing of the paper if the passage speed exceeds a certain limiting value.

SUMMARY OF THE INVENTION

The object of the present invention is to provide an improved device for forming groups of cigarettes in cigarette packaging machines, which is free from the aforesaid drawbacks.

Said object is attained according to the present invention by an improved device for forming groups of cigarettes in cigarette packaging machines of the type comprising an outlet hopper of a cigarette feed line, said hopper having a plurality of outlet valves; a forming wheel, along the periphery of which there are uniformly distributed axial containers for said groups, each said container being arranged to receive in succession several superposed layers of cigarettes, each layer being fed in a direction axial to said wheel from a respective said outlet mouth by pusher means in a position corresponding with a station for loading said cigarette onto said wheel; and retention means for retaining said layers in position inside the relative containers during the formation of said groups; and is substantially characterised in that said retention means comprise presser means which are arranged to act on said layers of each group in a direction radial to said wheel and are mobile with this latter about an axis thereof at least during the traversing of said loading station by said containers, cam means being provided for transmitting to said presser means oscillating movements in a direction radial to said wheel during the formation of said groups.

The novel features which are considered as characteristics, of the invention are set forth in particular in the appended claims. The device itself, however, both as to its construction and its mode of operation, together with additional features and advantages thereof, will the best understood upon perusal of the following detailed description of certain specific embodiments with reference to the accompanying drawings.

DESCRIPTION OF THE PREFERRED EMBODIMENTS

Figure 1:
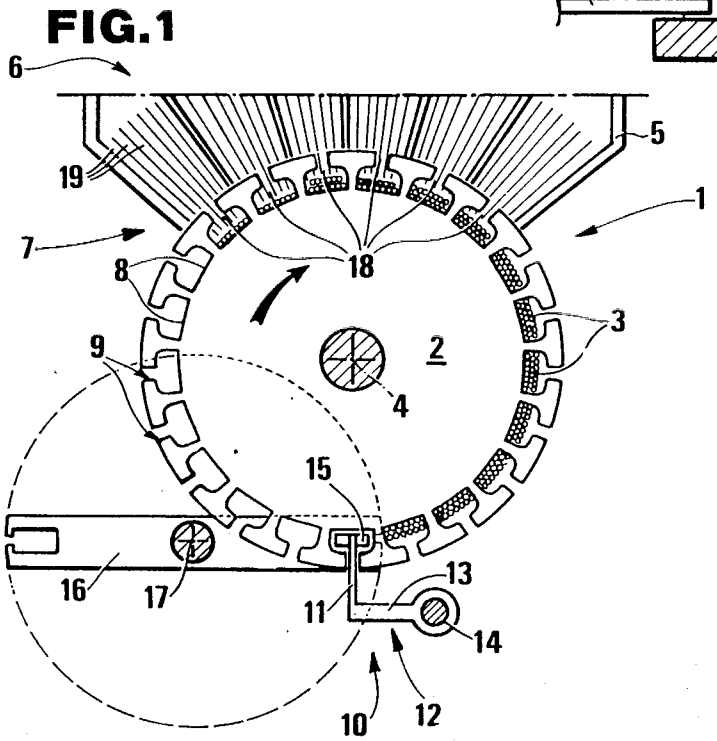
FIG. 1 is a diagrammatic elevation of a forming device constructed according to the present invention.

FIG. 1 shows a forming device indicated overall by 1 and comprising a wheel 2 for forming cigarette groups 3, each constituting the contents of one packet, not shown. The wheel 2 is mounted rotatable about an axis 4, and a part of its periphery is disposed facing one end of an outlet hopper 5 of a device 6 for feeding quantities of cigarettes to a loading station indicated overall by 7, in which the cigarettes fed through the hopper 5 are transferred to the inside of axial seats or containers 8 distributed uniformly along the periphery of the wheel 2.

Each container 8 is in the form of an axial channel communicating with the outside by way of an axial slot 9 arranged for engagement, at a loading station 10, by a radial arm 11 of a pusher indicated overall by 12. In addition to the radial arm 11, the pusher 12 also comprises a slide 13 slidable along a guide 14 disposed axially to the wheel 2, and a plate 15 arranged to slidably engage each container 8 in succession, in order to expel a formed group 3 therefrom and to feed it into a respective seat, not shown, provided on a transfer head 16 mounted rotatable about an axis 17 parallel to the axis 4.

As shown in FIG. 1, the cigarettes leave the hopper 5 through 6 mouths 18 of which those of each pair are equal, each mouth 18 comprising a number of channels 19 equal to the number of cigarettes contained in each of the layers of cigarettes constituting the groups 3.

Figure 3:
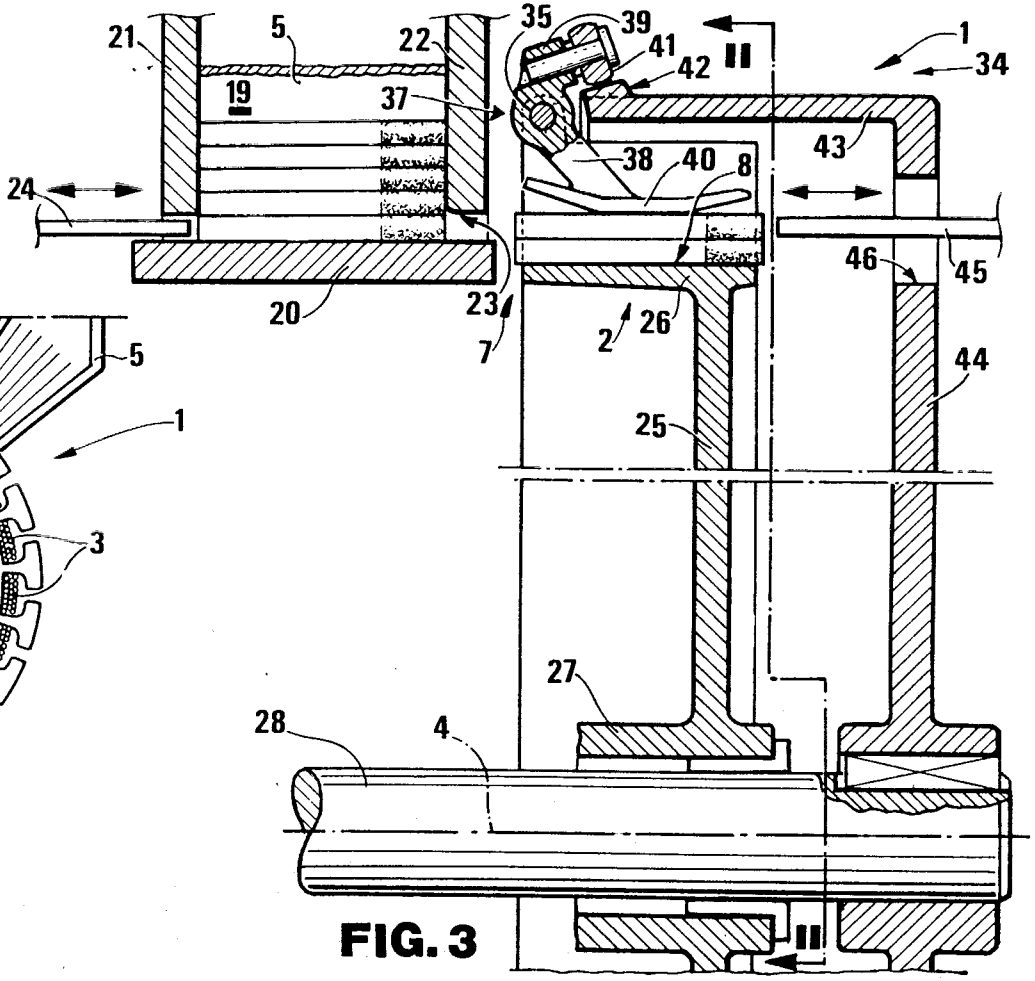
FIG. 3 is a section on the line III—III of FIG. 2.
Figure 5:
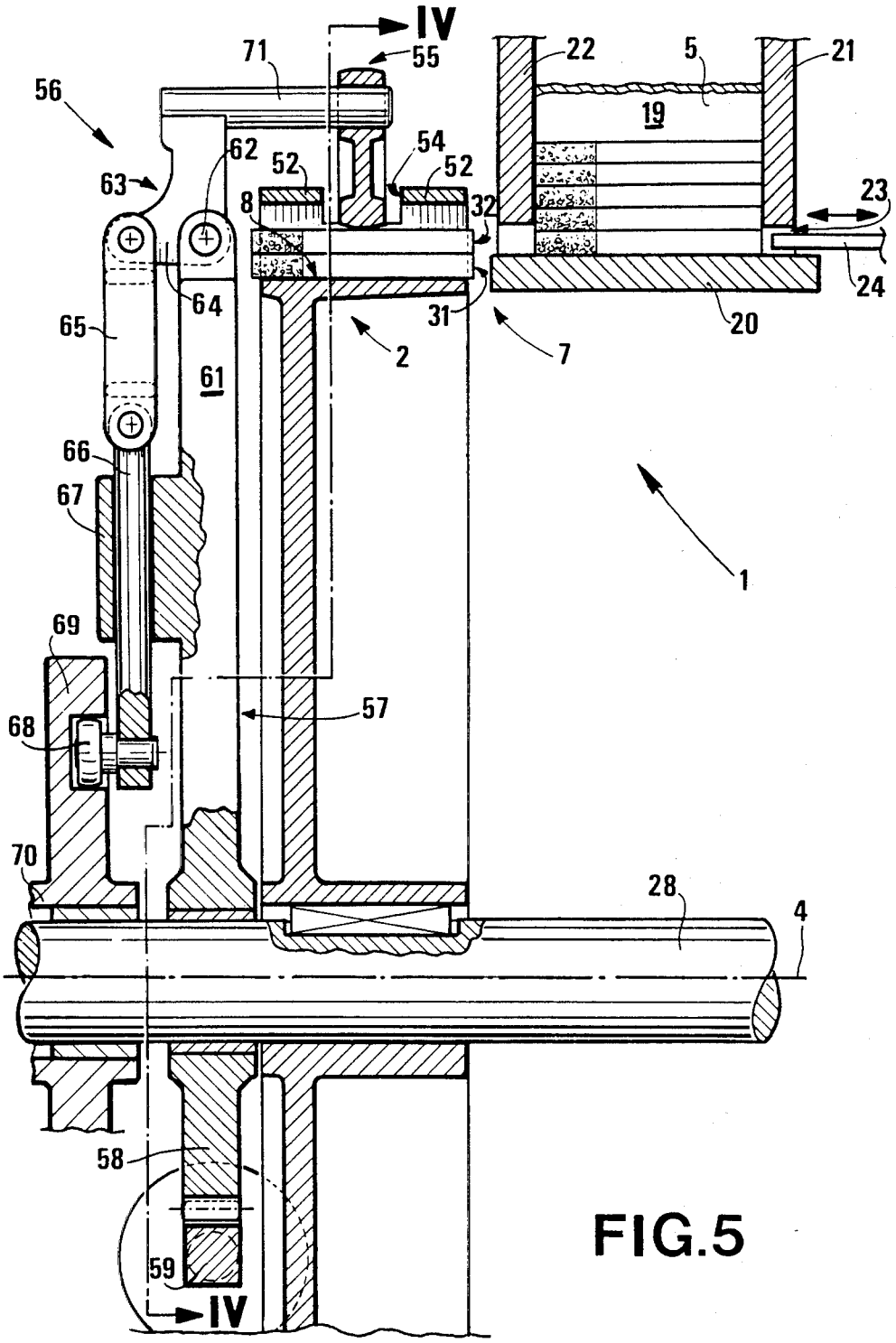
FIG. 5 is a section on the line V—V of FIG. 4.

As shown in FIGS. 3 and 5, the channels 19 are limited lowerly by a plate 20, and transversely by two plates 21 and 22 which in a position adjacent to the plate 20 are provided with a slot 23 arranged for engagement by a pusher 24 driven with reciprocating motion by actuator means, not shown.

Figure 2:
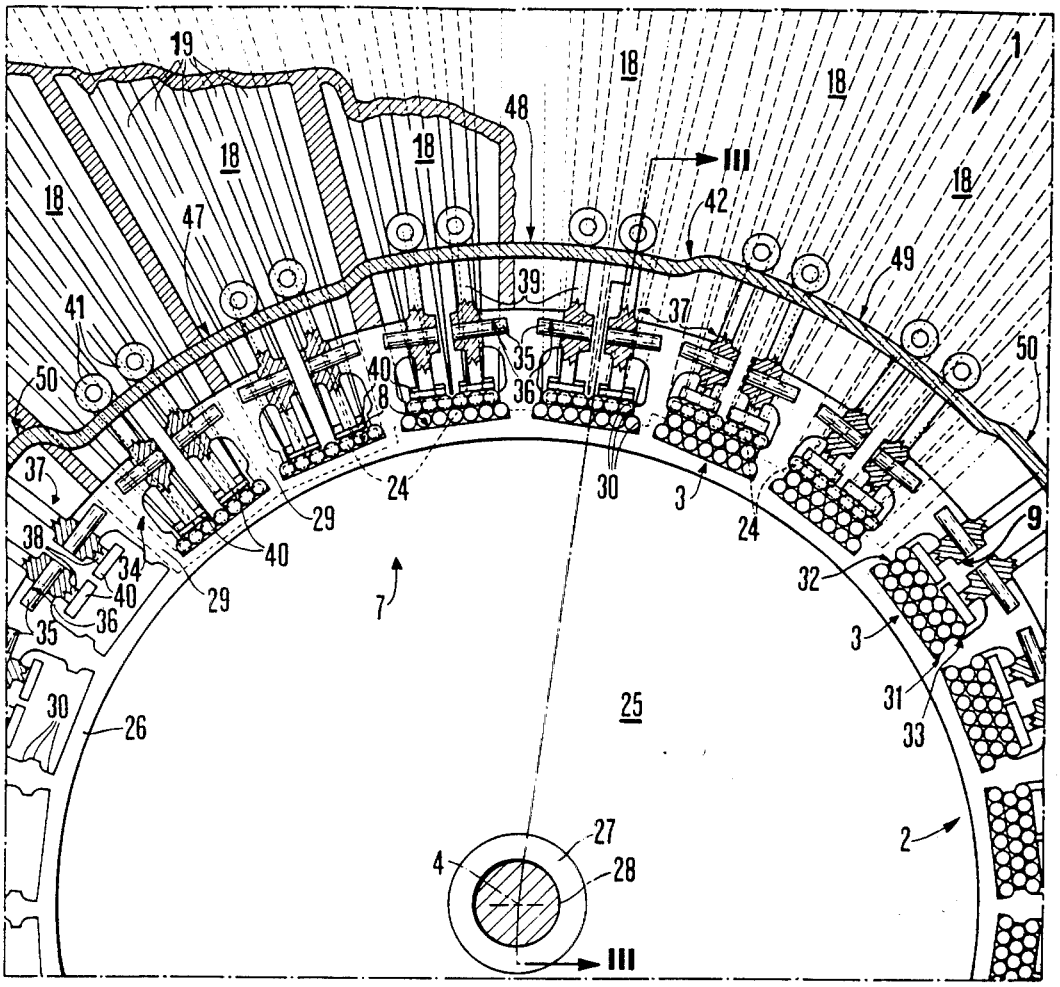
FIG. 2 is a section on the line II—II of FIG. 3, relative to a first embodiment of the device of FIG. 1.

In the embodiment shown in FIGS. 2 and 3, the wheel 2 comprises an annular plate 25, of which the outer periphery and inner periphery are connected to respective cylindrical sleeves 26 and 27. The sleeve 27 is mounted idly on a support shaft 28, and is angularly connected to a drive device, not shown, arranged to rotate the wheel 2 stepwise in a determined direction.

As shown in FIG. 2, the containers 8 are provided along the outer periphery of the outher sleeve 26, and each is of substantially rectangular cross-section.

Said containers 8 are separed from each other by an axial rib 29 substantially of T cross-section, and profiled along its intermediate part in such a manner as to define three radially superposed seats 30 for three layers of cigarettes 31, 32, and 33.

The wheel 2 is provided with a retention device indicated overall by 34, arranged to retain the cigarettes in the relative containers 8 during the formation of the groups 3. For each rib 29, the device 34 comprises 2 pins 35 disposed perpendicular to the shaft 28 and in a position tangential to the wheel 2. Each pin 35 is driven into a respective dead bore 36 provided in the relative rib 29, and rotatably supports a respective rocker 37 constituted by two arms 38 and 39. The arm 38 faces the wheel 2, and at its free end comprises a flexible foil or presser means 40 arranged to co-operate with the cigarettes of a respective layer 31, 32 and 33 in order to compress them towards the sleeve 26 of the wheel 2.

The arm 39 extends outwards from the wheel 2, and on its free end carries a roller tappet 41 provided with elastic means, not shown, which keep it in contact with the outer surface of a drum cam 42. This latter is disposed at the end of a cylindrical member 43 extending from a disc 44 keyed onto the shaft 28, which is connected to actuator means, not shown, arranged to transmit to it an oscillatory movement of determined amplitude about the axis 4.

As shown in FIG. 3, each pusher 24 is disposed coaxial to a counter-pusher 45 mobile with reciprocating motion through a respective aperture 46 provided in the disc 44. The counter-pusher 45 is arranged to accompany, for at least part of their path, the cigarettes of the relative layer 31, 32 or 33 moved by the relative pusher 24 from the lower end of the hopper 5 into the relative container 8.

As shown in FIG. 2, a first pair of pushers 24 is arranged to feed the first layer 31 of cigarettes into the relative containers 8, a subsequent pair of pushers 24 is arranged to feed the second layer 32 of cigarettes into the respective containers 8, and a final pair of pushers 24 is arranged to feed the third layer 33 of cigarettes into the respective containers 8.

From the aforegoing, the frequency of advancement of the wheel 2 about the axis 4 is equal to double the frequency of operation of the pushers 24 and 45, and is equal to the frequency of reciprocating movement of the slide 13.

As shown in FIG. 2, the cam 42 comprises a sliding track for the tappets 41, which comprises four steps 47, 48, 49 and 50 disposed in succession at increasing levels starting with the step 47.

Each of said steps 47, 48, 49 and 50 is engaged at the end of each insertion stage by four successive tappets 41, which during the insertion of the cigarettes into the relative containers 8 move into contact with the adjacent step of higher level by the effect of the oscillation of the cam 42 about the axis 4.

When in operation, at each two advancement steps of the wheel 2, six containers 8 become disposed inside the loading station 7 facing the lower ends of the six mouths 18 of the hopper 5. At each two advancement steps of the wheel 2, the pushers 24 and counter-pushers 45 are operated in such a manner as to extract the respective layers of cigarettes 31, 32 and 33 from the lower end of the relative mouths 18 and feed them into the relative containers 8.

At the commencement of the insertion stage, the cam 42 is rotated in the anti-clockwise direction in FIG. 2, so as to move the four tappets 41 relative to the formation of the layer 31 from the step 47 to the step 48, in order to raise the foils from the base of the respective containers 8 and allow the insertion of the constituent cigarettes of the said first layer 31.

Simultaneously, the four tappets 41 relative to the formation of the second layer 32 of cigarettes are moved into contact with the step 49, and the tappets 41 relative to the formation of the third layer 33 of cigarettes are moved into contact with the last step 50. The pairs of pushers 24 and counter-pushers 45 are all operated simultaneously such that at each two steps of the wheel 2 six layers of cigarettes become inserted into the six containers 8 which are inside the loading station 7, one layer per container. When insertion has taken place, the cam 42 rotates clockwise in FIG. 2 relative to the wheel 2 so as to return each tappet 41 onto the adjacent step of lower level in order to lower the foils 40 into contact with the cigarettes which have just been inserted, and to retain these latter in the relative containers 8.

Figure 4:
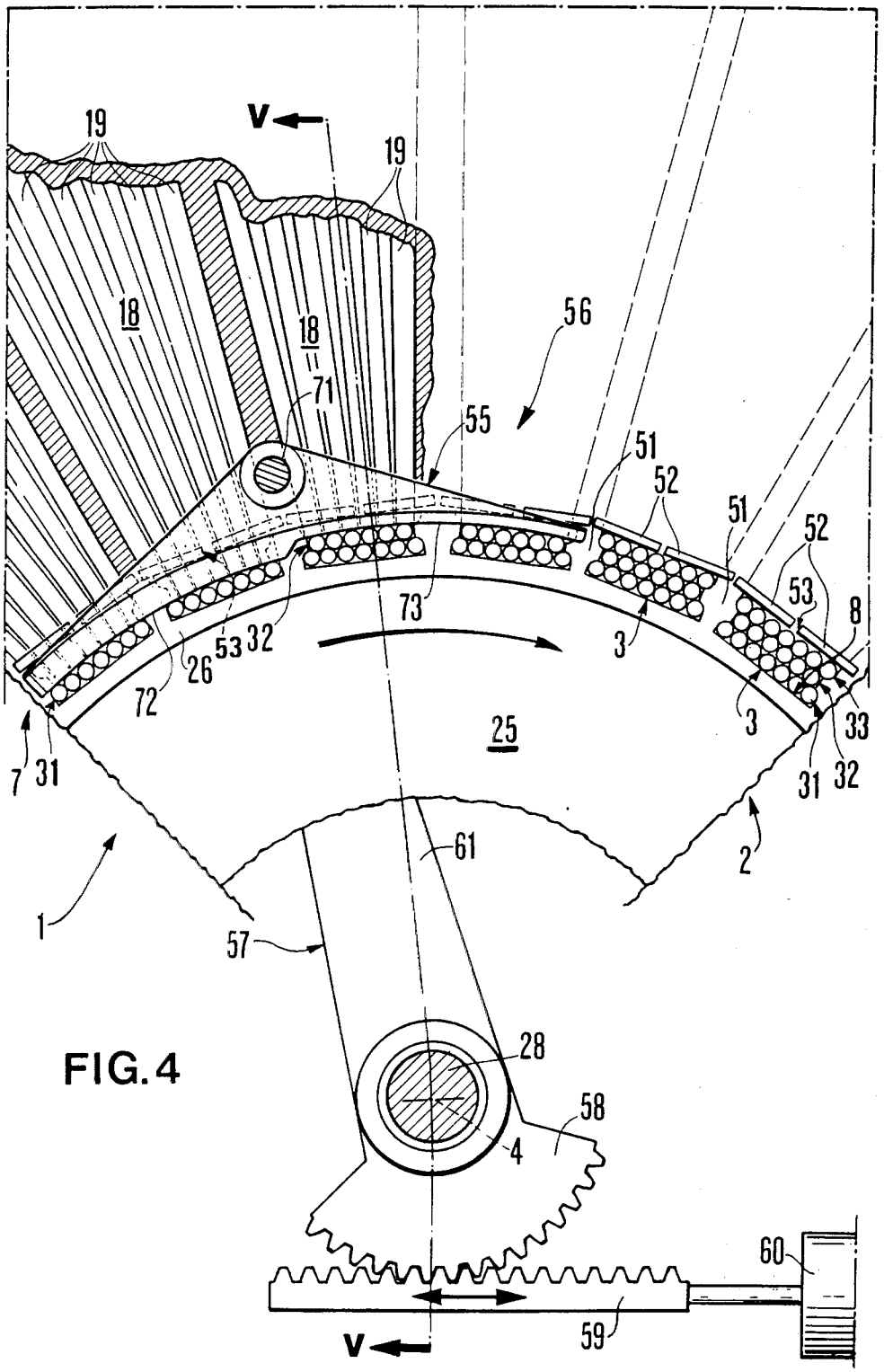
FIG. 4 is a section on the line IV—IV of FIG. 5, relative to a second embodiment of the device of FIG. 1.

In the modification shown in FIGS. 4 and 5, the containers 8 are defined on the outer surface of the sleeve 26 by axial ribs of substantially rectangular cross-section. Fixed covering means are connected to the end of the ribs 51, and are constituted by strips 52 disposed axially relative to the wheel 2 and extending tangentially thereto in order to define, between each pair of adjacent facing strips 52, a slot 53 extending axially along each container 8. Each strip 52 and each rib 51 is divided into two portions by a central circumferential slot 54 slidably engaged by a presser element indicated overall by 55 and forming part of a retention device indicated overall by 56. In addition to the presser element 55, the retention device 56 comprises a rocker or support 57 pivoted on the shaft 28 and comprising in its turn a first arm constituted by a toothed sector 58 engaging with a rack 59 driven with reciprocating motion by an actuator 60, and a second arm 61 which comprises connected to its free end a pin 62 perpendicular to the arm 61 and to the axis 4. On the pin 62 there is pivoted a rocker 63, of which a first arm 64 withdraws from the wheel 2 and carries keyed to its free end the end of a connection rod 65, which is hinged at its other end to the end of a rod 66 slidably mounted through a guide 67.

At that end facing the shaft 28, the rod 66 is provided with a tappet 68 disposed in contact with a cam 69 keyed onto a sleeve 70. This latter is rotatably supported by the shaft 28, and is operated by actuator means, not shown, in order to transmit to the cam 69 an oscillating rotary motion in order to move the rod 66 with reciprocating motion along the guide 67.

The rocker 63 has a second arm constituted by a pin 71 which extends parallel to the shaft 28 towards the wheel 2, and has keyed onto its free end the presser element 55.

As shown in FIG. 4, the presser element 55 is constituted by a substantially triangular plate with its vertex disposed substantially on the axis of the pin 71 and its major side facing the wheel 2 and defined by two circumferential arcs indicated respectively by 72 and 73 and having different radii of curvature. Specifically, the radius of the arc 72 is less than the radius of the arc 73 by a length substantially equal to the thickness of one layer of cigarettes 31, 32 or 33.

The operation of the retention device 56 is the same as that of the retention device 34. As a matter of fact, the presser element 55 is moved radially by the effect of the oscillation of the cam 69 so that it rises and thus allows insertion of the layers 31 and 32, then being lowered in order to keep these two first layers in position before insertion of the layer 33. This latter completes the groups 3, which after leaving the station 7 proceed while retained in position by the strips 52.

The only functional difference between the retention devices 34 and 56 is that whereas the foils 40 of the device 34 move with the wheel 2 and thus maintain the groups 3 inside the relative containers 8 during their entire advancement path towards the discharge station 10, the presser element 55 co-operates with the cigarettes fed into the containers 8 only within the loading station 7, and abandons the groups 3 once these have been formed.

Without further analysis, the foregoing will so fully reveal the gist of the present invention that others can, by applying current knowledge, readily adapt it for various applications without omitting features which lairly constitute essential characteristics of the generic and specific aspects of my contribution to the art and, therefore, such adaptions should and are intended to be comprehended within the meaning and range of equivalence to the claims.

We Claim:

1. An improved device for forming groups (3) of cigarettes in cigarette packaging machines of the type comprising an outlet hopper (5) of a cigarette feed line, said hopper (5) having a plurality of outlet mouths (18); a forming wheel (2), along the periphery of which there are uniformly distributed axial containers (8) for said groups (3), each said container (8) being arranged to receive in succession several superposed layers (31, 32, 33) of cigarettes, each layer being fed in a direction axial to said wheel (2) from a respective said outlet mouth (18) by pusher means (24, 25) disposed in a position corresponding with a station (7) for loading said cigarettes on to said wheel; and retention means (34; 56) for maintaining said layers (31, 32, 33) in position inside the relative containers (8) during the formation of said groups (3); the improvement residing in that said retention means (34; 56) comprise presser means (40; 55) which are arranged to act on said layers (31, 32, 33) of each group (3) in a direction radial to said wheel (2) and are mobile with said wheel about the axis (4) of said wheel at least during the traversing of said loading station (7) by said containers (8), cam means (42; 69) being provided for transmitting to said presser means (40; 55) oscillatory movements in a direction radial to said wheel (2) during the formation of said groups (3).

2. An improved device as claimed in claim 1, wherein said presser means comprise, for each said container (8), at least one foil (40) arranged to cooperate with the outer surface of the cigarettes contained in said container (8); each said foil (40) being connected to one end of a respective rocker (37) pivoted on said wheel (2) and arranged to cooperate with said cam means (42) to rotate about an axis (35) perpendicular to the axis (4) of said wheel (2).

3. An improved device as claimed in claim 2, wherein each said rocker (37) is provided with a tappet (41) at the end opposite that carrying the respective said foil (40); said cam means (42) comprising a sliding track for said tappets (41) which extends about said wheel (2) and is provided with a series of steps (47, 48, 49, 50), of number equal to $n+1$, where n is the number of said layers (31, 32, 33).

4. An improved device as claimed in claim 1, wherein each said container (8) is closed towards the outside in a direction radial to said wheel (2) by fixed cover means (52) defining a circumferential slot (54) slidably engaged by said presser means (55).

5. An improved device as claimed in claim 4, xherein said presser means comprise a presser means comprise a presser element (55) constituted by a plate disposed external to said wheel (2) at said loading station (7); said plate slidably engaging said circumferential slot (54) and being limited, on that side facing said wheel, by a series of arcs (72, 73) of different radii, and of number equal to $n-1$, where n is the number of said layers (31, 32, 33) which constitute one said group (3).

6. An improved device as claimed in claim 5, wherein said retention means (56) comprise a support (57) oscillating about the axis (4) of said wheel (2), and a rocker (63) mounted on said support (57) and rotatable about an axis (62) perpendicular to the axis (4) of said wheel (2); one end of said rocker (63) being connected to said presser element (55) and the other end cooperating with said cam means (69).

7. An improved device as claimed in claim 1, wherein said pusher means (24, 25) comprise, for each said layer (31, 32, 33), a pusher (24) and a counter-pusher (45) which are mutually coaxial and are driven with reciprocating motion in a direction parallel to said axis (4) of said wheel (2) in order to respectively engage the opposite ends of the cigarettes during at least part of their transfer from said hopper (5) to said wheel (2).

* * * * *